US005317114A

United States Patent [19]

Pullela et al.

[11] Patent Number: 5,317,114

[45] Date of Patent: May 31, 1994

[54] ELEVATOR SYSTEM HAVING DYNAMIC SECTOR ASSIGNMENTS

[75] Inventors: V. Sarma Pullela, North Granby; Zuhair S. Bahjat, Farmington, both of Conn.

[73] Assignee: Otis Elevator Company, Farmington, Conn.

[21] Appl. No.: 799,572

[22] Filed: Nov. 27, 1991

[51] Int. Cl.[5] ..... B66B 1/18; B66B 1/20

[52] U.S. Cl. ..... 187/128; 187/138; 187/127

[58] Field of Search ..... 187/124, 121, 138, 128, 187/127

[56] References Cited

U.S. PATENT DOCUMENTS

| | | | |
|---|---|---|---|
| 3,891,064 | 6/1975 | Clark . | |
| 4,305,479 | 12/1981 | Bittar et al. . | |
| 4,323,142 | 4/1982 | Bittar . | |
| 4,363,381 | 12/1982 | Bittar . | |
| 4,523,665 | 6/1985 | Tsuji . | |
| 4,524,418 | 6/1985 | Araya et al. . | |
| 4,792,019 | 12/1988 | Bittar et al. | 187/125 |
| 4,804,069 | 2/1989 | Bittar et al. | 187/125 |
| 4,838,384 | 6/1989 | Thangavelu . | |

OTHER PUBLICATIONS

1977 "Lift Supervisory Control Systems", G. C. Barney et al. *Lift-Traffic Analysis Design and Control,* Pub. P. Peregrinus Ltd., Chap. 3, pp. 85-147.

*Primary Examiner*—Steven L. Stephan
*Assistant Examiner*—Robert Nappi
*Attorney, Agent, or Firm*—Francis J. Maguire, Jr.

[57] ABSTRACT

Method and apparatus is disclosed for operating an elevator system that includes a group of elevator cars servicing a plurality of floor landings divided into Sectors. The method includes the steps of, with a controller associated with each elevator car of the group, (a) determining when the elevator car has reached a Turn Around Point for returning the elevator car to a lobby; (b) initiating travel to the lobby; and (c) determining when the elevator car has reached a predetermined Sector Assignment Fixation Point. After reaching the predetermined Sector Assignment Fixation Point, the method further includes the steps of (d) communicating Sector-related information with other controller of other elevator cars of the group; and (e) based upon the communication, assigning to the elevator car a next Sector to be serviced after arrival at the lobby. A round-robin arbitration technique is disclosed for assigning Sectors among the elevator cars.

21 Claims, 5 Drawing Sheets

ELEVATOR SYSTEM HAVING DYNAMIC SECTOR ASSIGNMENTS

TECHNICAL FIELD

This invention relates to elevator systems and, in particular, to a method and apparatus for assigning Sectors to elevator cars.

BACKGROUND OF THE INVENTION

Modern elevator systems often include distributed intelligence in the form of elevator car controllers, such as microprocessors.

In some modern elevator systems channeling is used as a means of ensuring smooth traffic flow during up-peak. The assignment of cars to a Sector, also referred to as a channel or zone, is done at the time the car reaches a lobby commitment point during the car's descent to the lobby. The assignment is accomplished in accordance with a round-robin arbitration technique, wherein the elevator car controller communicates with other elevator car controllers to determine which Sectors are already assigned, and then assigns to itself a next available Sector.

A Sector is comprised of one or more contiguous floor landings that are to be served by an elevator car after it leaves the lobby. The lobby commitment point is generally near to the lobby floor, and coincides with a Control Stop Point (CSP), where the elevator car begins to decelerate.

A result of this approach is that the assignment of the elevator car to a Sector may occur but a few seconds before the car reaches the lobby. After assignment, the elevator car provides a lobby display indicating which floors it will be servicing when it ascends.

However, due to the potentially large number of people waiting in the lobby during up-peak periods, situations may arise where it is difficult for passengers to physically move to the elevator car that is assigned to a Sector that includes the passenger's desired floor landing. Also, passengers must constantly monitor the lobby displays of all the cars so that they can move to the proper car.

In commonly assigned U.S. Pat. No. 4,363,381, issued Dec. 14, 1982, entitled "Relative System Response Elevator Call Assignments" to J. Bittar there is described an elevator system in which hall calls registered at a plurality of landings are assigned to cars on the basis of a summation of relative system response factors for each car, relative to each registered hall call.

Commonly assigned U.S. Pat. No. 4,305,479 issued Dec. 15, 1981, entitled "Variable Elevator Up Peak Dispatching Interval" to J. Bittar et al. describes a group controller that provides a variable interval between dispatching of elevator cars from a lobby during up-peak, the dispatching interval being controlled by an approximate round trip time of an elevator being dispatched from the lobby in serving the car calls registered within it and returning to the lobby, or the average of the approximate round trip time for two or three most recently dispatched elevator cars. The dispatching interval is determined by the approximate round trip time divided by the number of elevator cars serving the up-peak traffic. In addition, the dispatching interval can be further reduced in dependence upon the number of cars standing at the lobby, the reduction being greater for the case wherein the last car leaving the lobby is not more than half full, than in the case when the last car leaving the lobby is more than half full.

Commonly assigned U.S. Pat. No. 4,838,384, issued Jun. 13, 1989, entitled "Queue Based Elevator Dispatching System Using Peak Period Traffic Prediction" to K. Thangavelu describes a combined prediction technique to assign hall calls to cars on a priority basis for floors having a predicted high level of passenger traffic. During up-peak periods the lobby is given high priority, with a lobby passenger queue being predicted using passenger arrival rates and expected car arrival times.

It is an object of this invention to provide an elevator system that provides for an elevator car Sector assignment to be accomplished at an earlier point than the conventional lobby commitment point.

It is a further aspect of the invention to provide an elevator system wherein sectoring assignments are accomplished at or soon after an elevator car turn around point.

SUMMARY OF THE INVENTION

The foregoing and other problems are overcome and the objects of the invention are realized with a method for assigning sectors to elevator cars, and with apparatus for accomplishing the method.

More specifically, a method is disclosed for operating an elevator system that includes a group of elevator cars servicing a plurality of floor landings divided into Sectors. The method includes the steps of, with a controller associated with each elevator car of the group, (a) determining when the elevator car has reached a Turn Around Point for returning the elevator car to a lobby; (b) initiating travel to the lobby; and (c) determining when the elevator car has reached a predetermined Sector Assignment Fixation Point. In one embodiment of the invention the Sector Assignment Fixation Point is a fixed point above the Control Stop Point. In another embodiment of the invention the Sector Assignment Fixation Point is a dynamically assigned point that may be the Turn Around Point, the Control Stop Point, or any point in between. After reaching the predetermined Sector Assignment Point the method further includes the steps of (d) communicating Sector-related information with other controller of other elevator cars of the group; and (e) based upon the communication, assigning to the elevator car a next Sector to be serviced after arrival at the lobby.

The step of assigning includes a step of providing a message to waiting lobby passengers, the message being expressive of the floors associated with the assigned next Sector. The step of assigning further includes a step of initializing a timer to record an elapsed time between the time the next Sector is assigned and a time that the elevator car arrives at the lobby.

Responsive to a registration of a hall call at a floor landing that is intermediately located between a current position of the elevator car and the lobby the method further includes the steps of stopping the elevator car to service the registered hall call; and determining if the elapsed time exceeds a predetermined threshold. If the elapsed time is found to exceed the predetermined threshold, the method includes a further step of relinquishing the assigned next Sector and removing the provided message.

In a preferred embodiment of the invention the step of assigning includes a step of determining the next Sector in accordance with a round-robin arbitration technique that is accomplished in accordance with the information that is communicated between the elevator car controllers.

The predetermined Sector Assignment Fixation Point may be a fixed point, such as a point approximately equal to the Turn Around Point or a point midway between the Turn Around Point and the lobby. The predetermined Sector Assignment Fixation Point may also be a variably located point that is determined by an intelligent group controller as a function of measured passenger traffic and/or as a function of an estimate of passenger traffic based upon a historical record of passenger traffic.

BRIEF DESCRIPTION OF THE DRAWINGS

The foregoing aspects of the invention will be made more apparent in the ensuing detailed description when read in conjunction with the accompanying drawings, wherein.

DETAILED DESCRIPTION OF THE INVENTION

The disclosure of commonly assigned U.S. Pat. No. 4,363,381, issued Dec. 14, 1982, entitled "Relative System Response Elevator Call Assignments" to J. Bittar is incorporated herein by reference in its entirety, as is the disclosure of commonly assigned U.S. Pat. No. 4,838,384, issued Jun. 13, 1989, entitled "Queue Based Elevator Dispatching System Using Peak Period Traffic Prediction" to K. Thangavelu. Also incorporated herein by reference is the disclosure of commonly assigned U.S. Pat. No. 4,305,479 issued Dec. 15, 1981, entitled "Variable Elevator Up Peak Dispatching Interval" to J. Bittar et al.

Figure 1:
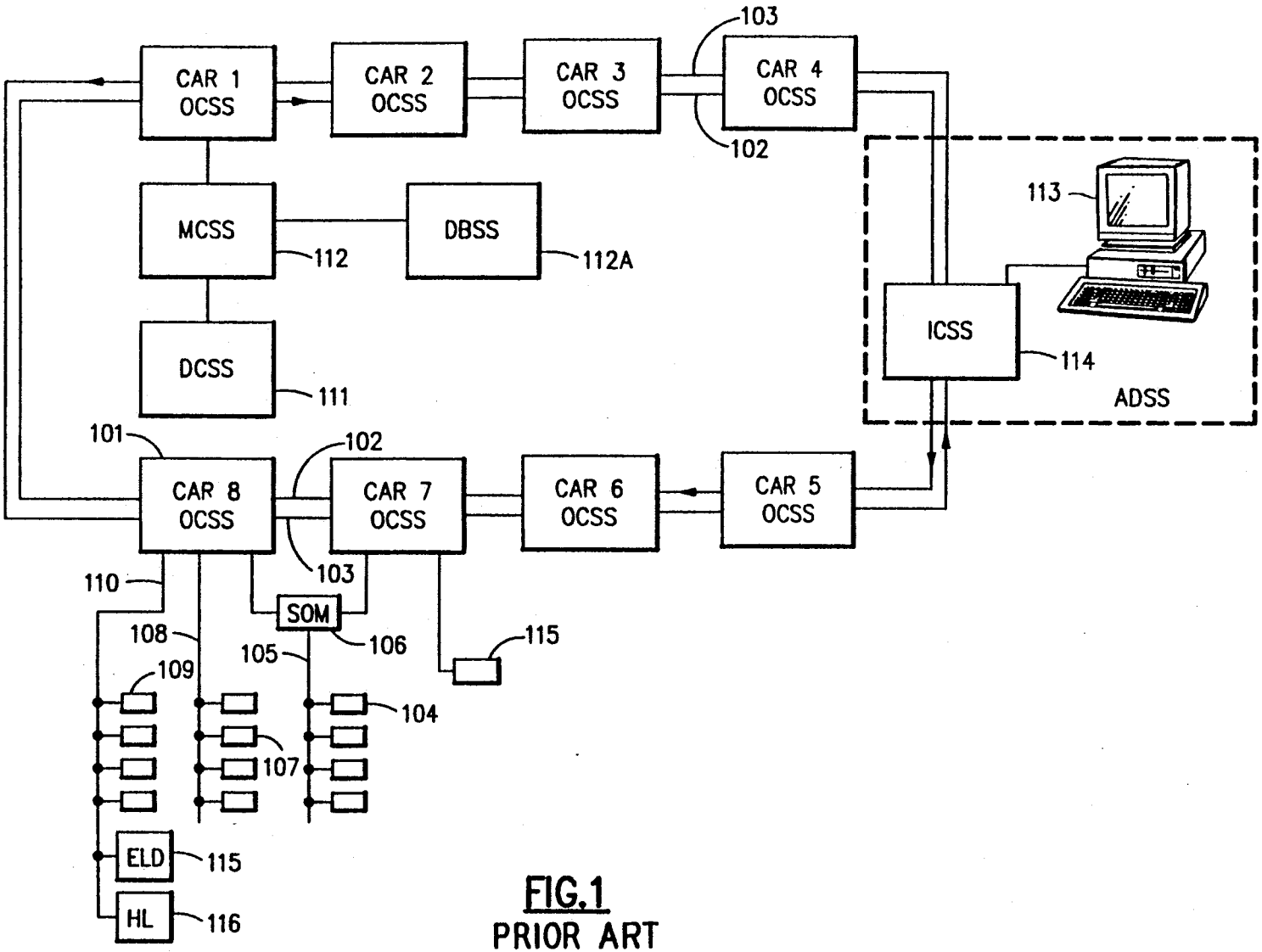
FIG.1 PRIOR ART
FIG. 1 is a block diagram of an elevator system that is constructed and operated in accordance with the invention.

FIG. 1 is a block diagram that depicts an elevator system of a type described in co-pending and commonly assigned U.S. patent application Ser. No. 07/029,495, entitled "Two-Way Ring Communication System for Elevator Group Control", filed Mar. 23, 1987. This elevator system presents but one suitable configuration for practicing the invention. As described therein, an elevator group control function may be distributed to separate data processors, such as microprocessors, on a per elevator car basis. These microprocessors, referred to herein as operational control subsystems (OCSS) 101, are coupled together with a two-way ring communication bus (102, 103). For the illustrated embodiment the elevator group consists of eight elevator cars (CAR 1–CAR 8) and, hence, includes eight OCSS 101 units.

For a given installation, a building may have more than one group of elevator cars. Furthermore, each group may include from one to some maximum specified number of elevator cars, typically a maximum of eight cars.

Hall buttons, for initiating elevator hall calls, and lights are connected with remote stations 104 and remote serial communication links 105 to each OCSS 101 via a switchover module (SOM) 106. Elevator car buttons, lights, and switches are coupled through similar remote stations 107 and serial links 108 to the OCSS 101. Elevator car specific hall features, such as car direction and position indicators, are coupled through remote stations 109 and a remote serial link 110 to the OCSS 101. These specific car features include an Elevator Lobby Display (ELD) 115, comprised of an alphanumeric display device, and a lobby Hall Lantern (HL) 116.

It should be realized that each elevator car and associated OCSS 101 has a similar arrangement of indicators, switches, communication links and the like, as just described associated therewith. For the sake of simplicity only those associated with CAR 8 are shown in FIG. 1.

Car load measurement is periodically read by a door control subsystem (DCSS) 111, which is a component of a car controller system. The load measurement is sent to a motion control subsystem (MCSS) 112, which is also a component of the car controller system. The load measurement in turn is sent to the OCSS 101. DCSS 111 and MCSS 112 are preferably embodied within microprocessors for controlling the car door operation and the car motion, under the control of the OCSS 101. The MCSS 112 also works in conjunction with a drive and brake subsystem (DBSS) 112A.

A car dispatching function is executed by the OCSS 101, in conjunction with an advanced dispatcher subsystem (ADSS) 113, which communicates with each OCSS 101 through an information control subsystem (ICSS) 114. By example, the measured car load is converted into boarding and deboarding passenger counts by the MCSS 112 and sent to the OCSS 101. The OCSS 101 subsequently transmits this data over the communication buses 102, 103 to the ADSS 113, via the ICSS 114. Also by example, data from a hardware sensor mounted on the car's door frame may sense boarding traffic, and this sensed information is provided to the car's OCSS 101.

As such, it can be seen that the ICSS 114 functions as a communication bus interface for the ADSS 113, which in turn influences high level elevator car control functions and parameters.

The ADSS 113 may also collect data on individual car and group demands throughout the day to arrive at a historical record of traffic demands for different time intervals for each day of the week. The ADSS 113 may also compare a predicted demand to an actual demand so as to adjust elevator car dispatching sequences to obtain an optimum level of group and individual car performance.

Various aspects of this functionality are described in commonly assigned U.S. Pat. No. 5,024,295, issued Jun. 19, 1991, entitled "Relative System Response Elevator Dispatcher System using Artificial Intelligence to Vary Bonuses and Penalties" to K. Thangavelu, the disclosure of which is incorporated herein in its entirety. In this commonly assigned U.S. patent the use of historically based and real-time predictions of elevator group loading are accomplished by a group controller 17 (FIGS. 1 and 2). It should be realized that this same functionality may be accomplished by the ADSS 113 in the elevator system architecture herein depicted in FIG. 1.

Having thus set forth the functionality of the exemplary elevator system of FIG. 1, a detailed description of the operation of the invention is now provided.

The invention is useful in an elevator system having sectors that are assigned by considering various criteria, such as a number of functional cars, a number of floors in the building, etc. Conventionally, the number of Sectors (S) is determined by dividing the total number of floors (F) by the number of elevator cars (EC) in operation, minus "X" where X=1, 2, etc. That is, $$S=F/(EC-X).$$

By example, if there are 12 floors, four cars, and if X=1, then there are four sectors each including a plurality of contiguous floors. The lobby (floor 1) is not included within a Sector and, as a result, floors 2–4 are included within Sector 1, floors 5–7 are included within Sector 2, floors 8–10 are included within Sector 3, and floors 11 and 12 are included within Sector 4. The one additional car is reserved for servicing any of the Sectors as required.

The elevator system may or may not have a central intelligent processor, such as the ADSS 113, having artificial intelligence logic to predict a number of people boarding at the lobby and deboarding at each floor for both up and down directions for short intervals throughout the day.

Generally, the invention operates such that during a given period, such as a MIT (moderate incoming traffic) period, also referred to as an up-peak period, each car considers its highest call in the system before returning to the lobby. When this floor is reached, and when the car is turning around to come back to the lobby, and if there are no hall calls assigned to the car on intermediate floors, the car assigns itself to a Sector when it reaches a predetermined sector assignment point. This assignment is based upon an arbitration technique, such as a round-robin arbitration technique. The Sector information is immediately provided to the ELD 115 that corresponds to the car. By example, the ELD 115 displays the message "SERVING FLOORS 8–10". For this example floors 8–10 are the floors that comprise the Sector assigned to the elevator car. When the CSP is reached the hall lantern 116 is turned on. This technique provides sufficient time for passengers to congregate near to the car's hall door if they intend to go to any floor between 8–10. After displaying the lobby message the amount of time that elapses until the elevator's door opens is a function of the elevator car's flight time from where the car is presently located to the lobby, plus the amount of time required to answer down hall calls assigned to elevator car, if any, after it has made the Sector assignment, but before it reaches the lobby.

It should be noted that in a typical office building inter-floor traffic and counter-flow traffic during up-peak periods is negligible. However, some maximum time, such as 30 seconds, is provided within which to release the self-assigned Sector before the car arrives at the lobby. This prevents waiting passengers from being required to wait for an excessively long period in the event the elevator car is required to respond to a significant number of down hall calls, or if the car is held for an inordinately long period at a hall call floor.

More specifically, and referring to the flow diagram of FIGS. 3*a* and 3*b* in conjunction with FIGS. 2*a* and 2*b*, a first embodiment of a method of the invention operates as follows. For this discussion it is assumed that an up-peak period is in effect.

At Block A the OCSS 101 of an ascending elevator car determines if it has reached its highest call within a presently assigned Sector. If NO, the determination of Block A is made again. If YES, the car has reached its Turn Around Point (TAP) and the OCSS 101 initiates the descent to the lobby (Block B). At Block C the OCSS 101 of the descending car determines if it has been assigned any intermediate hall calls. That is, if any hall calls are registered for this car between the present location of the car and the lobby. If YES, the car executes Block D to stop and service the intermediate hall call(s), after which control returns to Block C. If NO, the car determines at Block E if it has reached a sector Assignment Fixation Point (AFP). If NO, the car continues its descent while continuously making the determination at Blocks C and E. If YES, the OCSS 101 assigns to itself a next Sector (n) based on an arbitration criterion. In a presently preferred embodiment of the invention the arbitration criterion is based on a round-robin arbitration technique, although the practice of the invention is not limited to only this one particular arbitration technique.

To make this determination, the OCSS 101 of the descending elevator car communicates with the OCSS 101 units of the other elevator cars of the group over the ring communication bus 102, 103 and obtains therefrom the assigned Sectors of the other cars. The OCSS 101 then assigns to itself the next available sector.

Figure 2B:
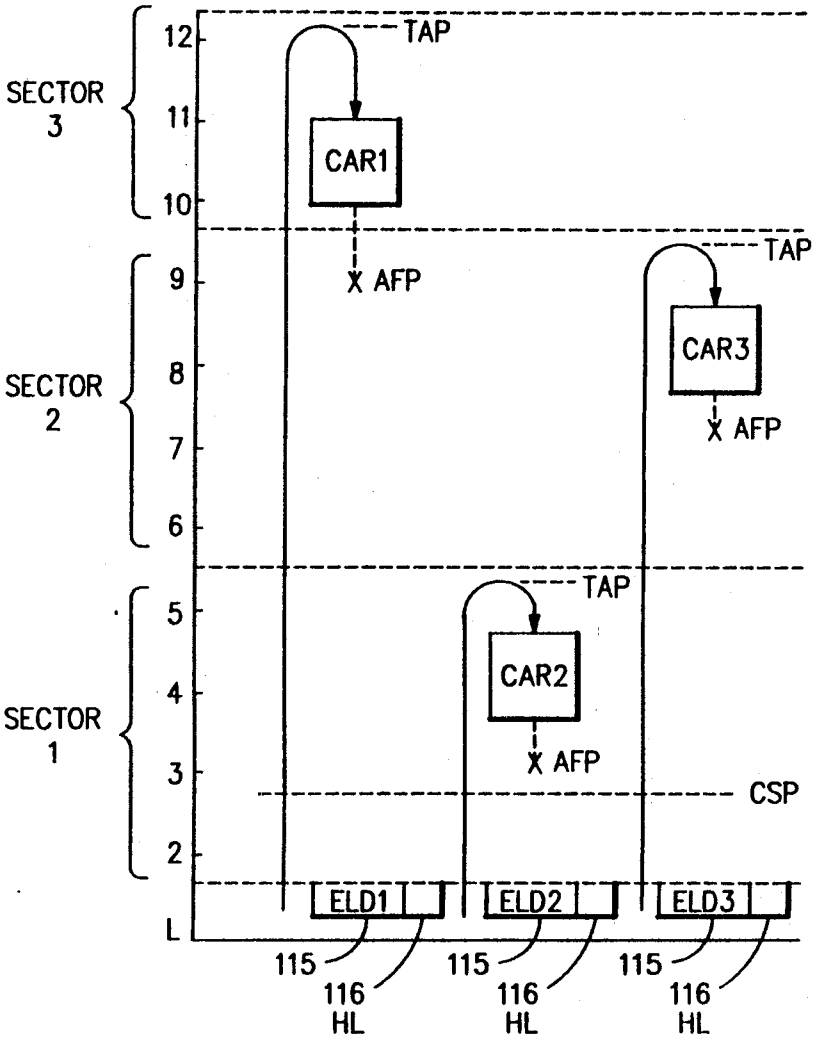
FIGS. 2*a* and 2*b* illustrate, for two consecutive time periods, a sectoring assignment made between three elevator cars, the sectoring assignment being based upon a round robin arbitration technique.
Figure 2A:
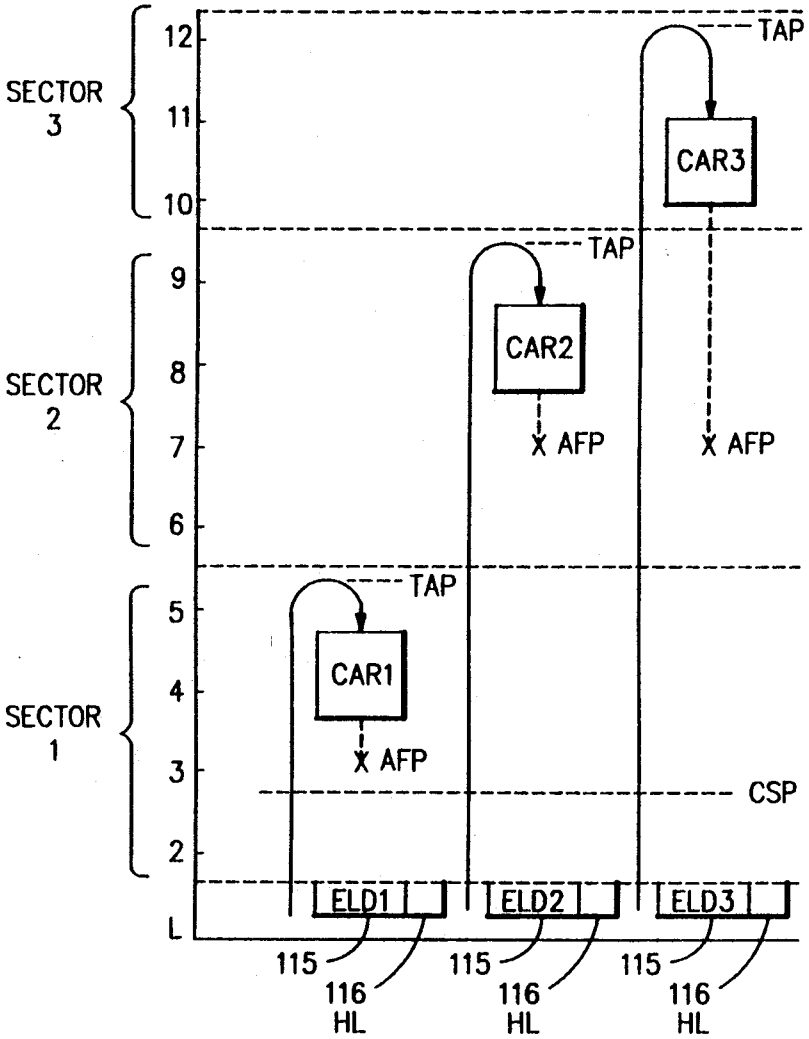

FIGS. 2*a* and 2*b* show exemplary Sector assignments, for a twelve story building, for three out of five elevator cars (CAR1–CAR3), and for two consecutive time intervals. The floor allocation to Sectors is determined as previously described (S=F/(EC−X)). For the first interval depicted in FIG. 2*a*, CAR1 is assigned to Sector 1 (floors 2–5), CAR2 is assigned to Sector 2 (floors 6–9), and CAR3 is assigned to Sector 3 (floors 10–12). For the second time interval, depicted in FIG. 2*b*, CAR1 is assigned to Sector 3, CAR2 is assigned to Sector 1, and CAR3 is assigned to Sector 2.

Figure 3A:
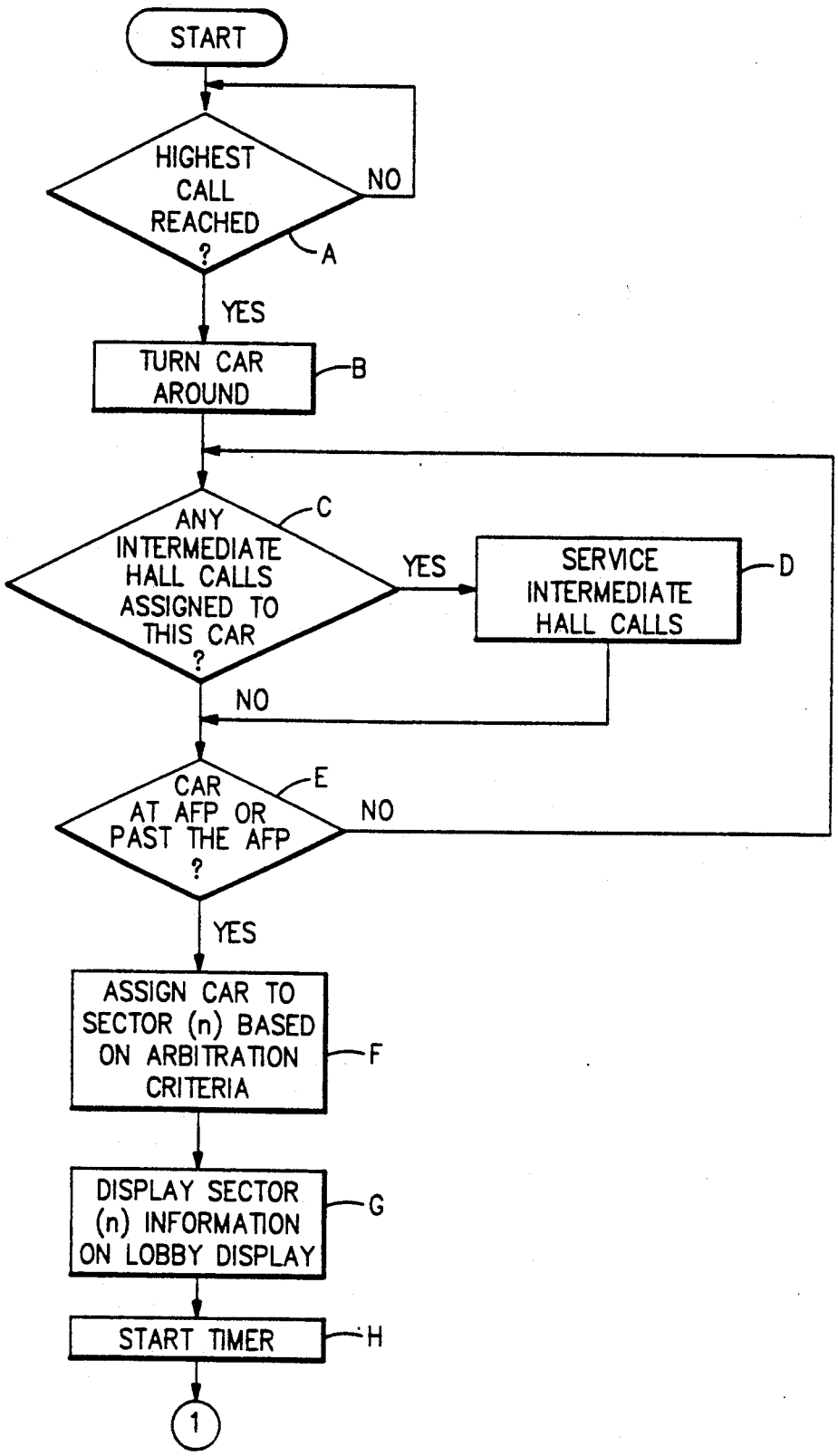
FIGS. 3*a* and 3*b* are a logic flow diagram illustrating a first embodiment of a method of the invention for dynamically assigning a next Sector to an elevator car.
Figure 3B:
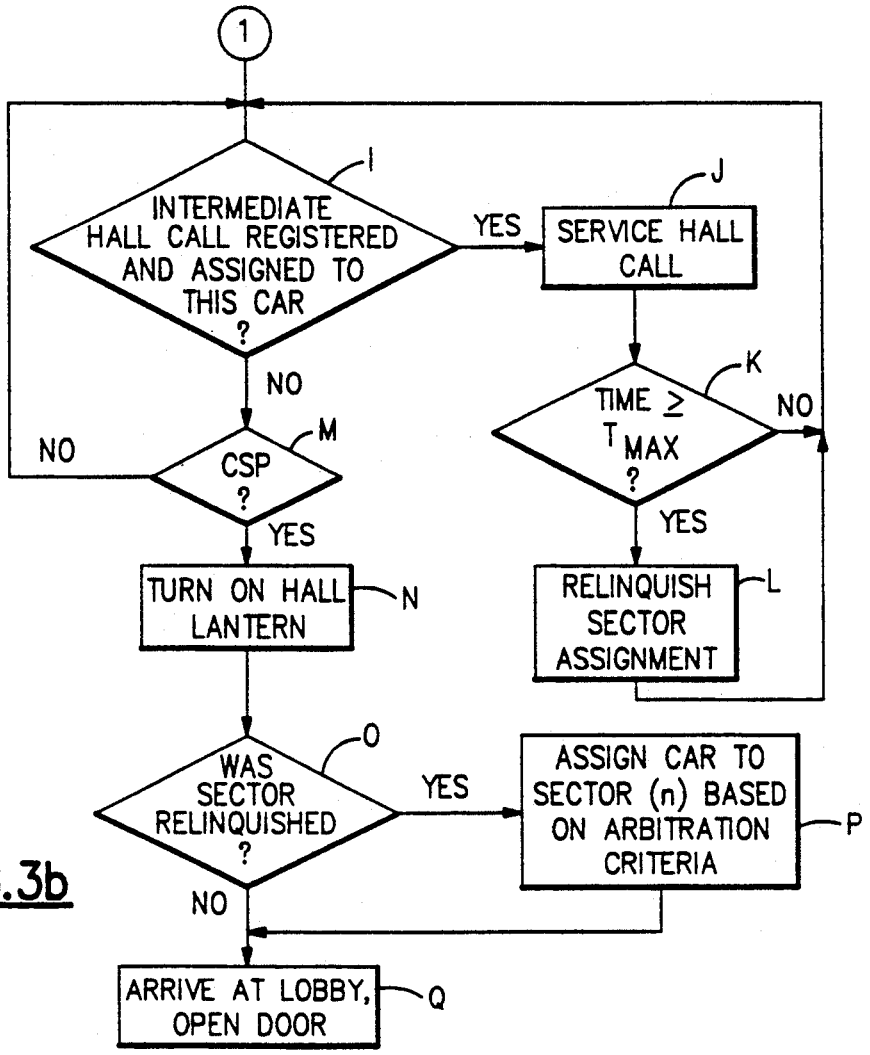

Returning to the flow diagram of FIGS. 3*a* and 3*b*, after assigning itself to a next Sector the car displays the assigned Sector information as a message on the Elevator Lobby Display (ELD) 115. As a result, passengers waiting in the lobby are notified of which descending cars will be serving which Sectors during these cars' next ascent. Furthermore, the waiting passengers are provided with ample time to reach the vicinity of the elevator car door before the car actually arrives and opens the door to allow the passengers to board.

At Block H, and approximately coincidentally with the execution of the steps at Blocks F and G, the OCSS 101 starts an internal timer, which may be embodied either within a software timer or a hardware timer. At Block I the OCSS 101 determines if an intermediate hall call has been assigned to the car. If YES, the car stops and services the intermediate hall call (Block J). At Block K a determination is made if the elapsed time indicated by the internal time is equal to or greater than a predetermined maximum time ($T_{MAX}$), for example 30 seconds. If NO, control returns to Block I where the car continues to monitor for intermediate hall calls during its descent to the lobby. If YES at Block K, the car relinquishes its previously self-assigned Sector assignment and removes the previously displayed message from the ELD 115 (Block L). Operation then continues at Block I. The operation of Blocks K and L prevents a Sector from being "locked-up" for an inordinately long period of time while the car makes a number of intermediate hall call stops, or if the car is held at an intermediate landing for an inordinately long period of time. As a result, lobby passengers waiting to ascend to a particular floor are serviced in a rapid and efficient manner. For this case the relinquished Sector is subsequently self-assigned by another car.

Returning to the discussion of Block I, during this time the elevator car is continuing to make its descent towards the lobby. At Block M the OCSS 101 determines if it has reached its CSP. If NO, operation continues at Block I. If YES, the elevator car begins decelerating. The CSP, for a high speed elevator car, may be approximately one and a half floors above the lobby. The actual position of the CSP is determined by elevator speed, motion profile, and other related criteria. Furthermore, each elevator car may have a different CSP, in that a car descending from a higher floor may achieve a greater velocity than a car descending from a lower floor. Having reached the CSP, at Block N the OCSS 101 turns on the associated hall lantern 116. At Block 0 the OCSS 101 determines if it has previously relinquished (at Block L) a previously assigned next Sector. If YES, the OCSS 101 assigns itself the next available Sector in a conventional manner and provides the appropriate lobby display. If NO at Block 0, or after executing Block P, the car arrives at the lobby and opens its door so that the waiting passengers are enabled to board (Block Q). At this time the OCSS 101 also flashes the ELD display 115 and the hall lantern 116.

It should be noted that once an elevator car reaches its AFP and assigns itself to a Sector for its next ascent, this Sector assignment becomes fixed unless relinquished because of a waiting time violation. Thus, the location of the AFP is an important consideration. If the AFP is coincident with or is near to the TAP then the waiting lobby passengers are provided with a substantial amount of time during which to identify the elevator car that will be next servicing the passengers' destination floors. As a result, the waiting passengers have an adequate amount of time during which to make their way to the elevator car. However, it may also be advantageous to provide the AFP nearer to the lobby in that it provides the elevator car with greater flexibility insofar as Sector assignments are concerned. That is, the Sector assignments are not fixed as early, thereby enabling the elevator car to make several intermediate stops before reaching the lobby, without exceeding the predetermined waiting period ($T_{MAX}$) that results in a cancellation of the previously made Sector assignment at Block M.

In practice, the AFP may be fixed so that it coincides with the TAP for all cases, thereby maximizing the lobby passenger notification time. The AFP may also be fixed at some specified point that is intermediate between the TAP and the Control Stop Point. By example, the TAP may be set at a point halfway between the TAP and the Control Stop Point. It is also within the scope of the invention to provide communication between the ADSS 113 and each OCSS 101 such that the AFP is determined as a function of traffic intensity.

Using techniques described in the above referenced commonly assigned U.S. Pat. No. 4,838,384, issued Jun. 13, 1989, entitled "Queue Based Elevator Dispatching System Using Peak Period Traffic Prediction" to K. Thangavelu, the ADSS 113 determines traffic intensity in a real time manner by monitoring the traffic intensity over a plurality of recent time intervals. The ADSS 113 may also determine traffic intensity based upon historical records of traffic intensity for a current time period. That is, for five minute intervals during the up-peak period the ADSS 113 may predict the traffic intensity based upon the historical record of traffic intensity during each of the five minute intervals. The ADSS 113 may also specify the AFP as a function of both real time and historical traffic intensities.

As an example, for a measured and/or predicted up-peak traffic intensity above a predetermined maximum threshold intensity the AFP is set by the ADSS 113 at the TAP, thereby providing a maximum amount of lobby passenger Sector notification time. For an up-peak traffic intensity between the maximum threshold and an intermediate threshold the AFP is set midway between each elevator car's TAP and the CSP. For a traffic intensity that is less than the intermediate up-peak intensity threshold, the AFP is set at the CSP, thereby providing a minimum amount of lobby passenger notification while also providing greater flexibility in the assignment of intermediate hall calls for the descending elevator cars.

Figure 4A:
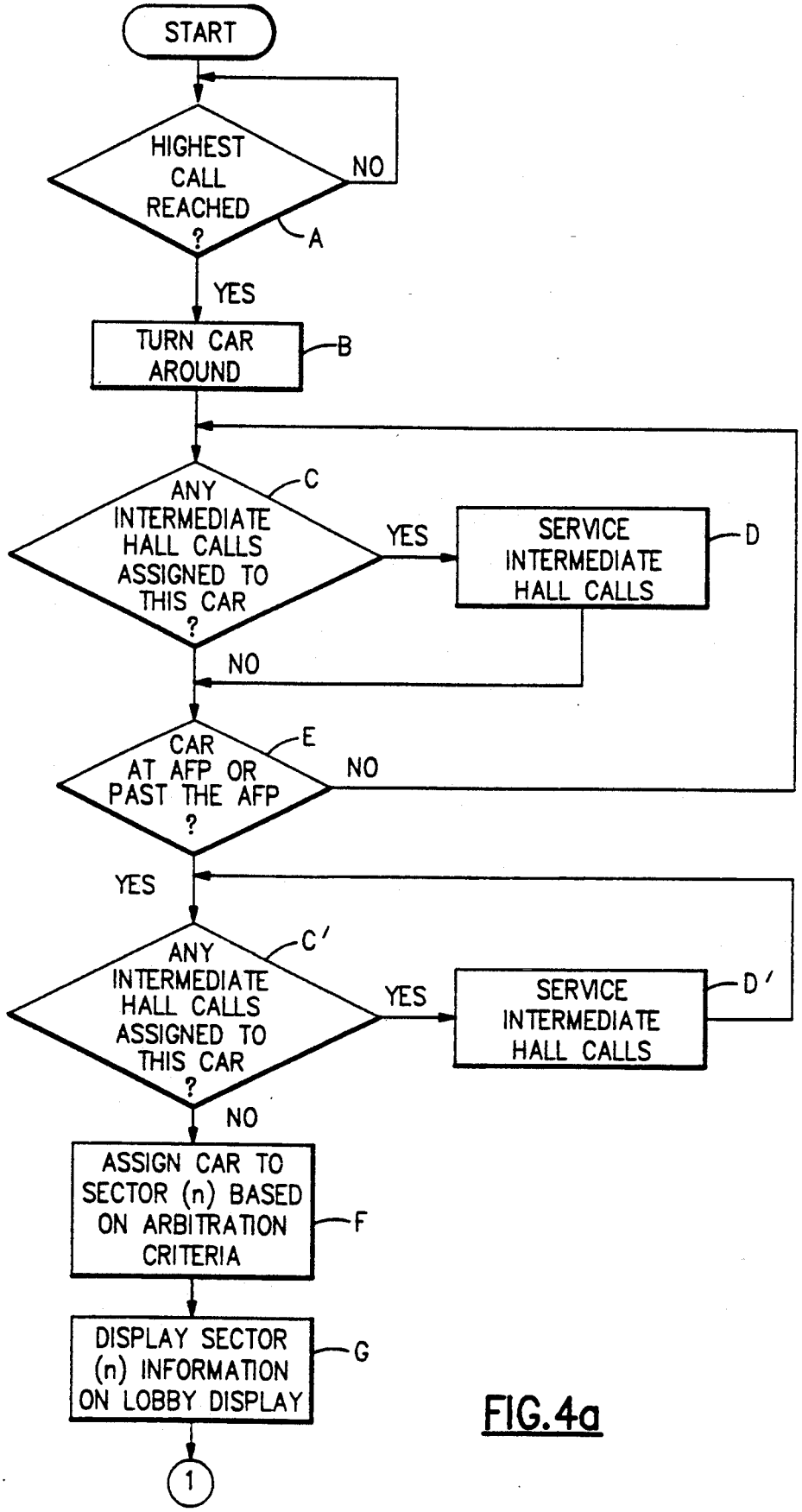
FIGS. 4*a* and 4*b* are a logic flow diagram illustrating a second embodiment of a method of the invention for dynamically assigning a next Sector to an elevator car.
Figure 4B:
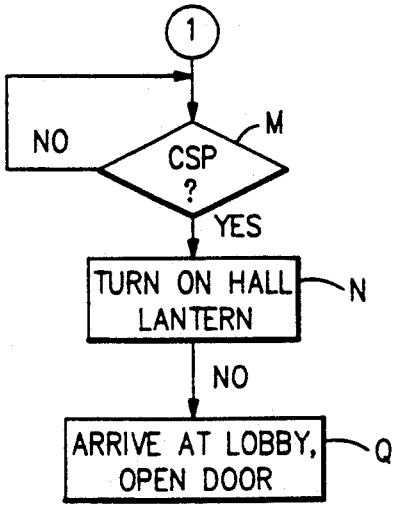

Referring to the flow diagram of FIGS. 4*a* and 4*b*, a discussion is made of a further embodiment of a method of the invention. This embodiment minimizes an occurrence of an assigned Sector being relinquished due to a lobby waiting time violation. In FIGS. 4*a* and 4*b*, those Blocks labeled the same as in FIGS. 3*a* and 3*b* operate in a same manner. In this embodiment of the invention, and after reaching the AFP (Block E), the OCSS 101 determines if it has any intermediate down hall calls assigned to it (Block C'). If YES, the OCSS 101 services the one or more registered down hall calls (Block D'). If NO at Block C', then Block F is executed to assign the car to the next Sector (n). Execution then continues at Blocks G, M, N, and Q. For this embodiment, once the OCSS 101 determines that no further intermediate down hall calls are registered, it can be assured that once the Sector assignment is made that same will not be required to be relinquished because of the elapsed time equaling or exceeding $T_{MAX}$.

The use of the invention provides enhanced flexibility in the use of the elevator system in that it enables elevator car sector assignments to be varied in a real time fashion. Furthermore, the elevator car sector assignments may be varied as a function of traffic intensity on a real time basis and/or on a historical basis.

It is to be understood that the ranges and the preferred values of the various quantities specified above are empirical in nature and are preferably a function of the specific building configuration and its traffic patterns. As used herein, building configuration means the physical attributes of the building which impact traffic flow therethrough, including but not limited to number of floors, number of elevators, elevator speed, location of express zone(s), location of lobby level and/or parking level(s), total building population, and distribution of the population per floor.

Furthermore, it should be realized that the assignment of contiguous floors to sectors may be accomplished by other than the technique described above. For example, a dynamic allocation of contiguous floors to sectors may be accomplished in accordance with the disclosure of commonly assigned U.S. patent application Ser. No. 07/508,312, filed Apr. 12, 1990, entitled "Elevator Dynamic Channeling Dispatching for Up-Peak Period", by N. Kameli.

Thus, although described in the context of specific embodiments, it should be realized that a number of modifications may be made thereto. For example, in FIGS. 3*a*, 3*b*, 4*a*, and 4*b* certain of the steps may be executed in other than the order shown while still achieving the same result. As an example, the step of initializing the timer (Block H) could be executed before the step of displaying the sector information (Block G). Furthermore, the invention may be practiced with elevator systems having different architectures than that specifically shown in FIG. 1. Therefore, the invention is not intended to be limited to only the described embodiments, but is instead intended to be limited only as the invention is set forth in the claims which follow.

What is claimed is:

1. A method of operating an elevator system that includes a group of elevator cars servicing a plurality of floor landings divided into sectors, comprising the steps of:

with control means associated with each elevator car of the group, determining when the elevator car has reached a Turn Around Point (TAP) for reversing ascent and returning the elevator car to a lobby;

initiating descent of the elevator car to the lobby;

determining, during the descent of the elevator car, and before reaching a Control Stop Point (CSP) where the elevator car begins to decelerate, when the elevator car has reached a sector Assignment Fixation Point (AFP), after which assignment of a next sector to be serviced by the car in a next ascent is initiated;

responsive to a determination that the elevator car has reached the sector AFP, communicating sector-related information with other control means of other elevator cars of the group; and based upon the communication, assigning to the elevator car the next sector to be serviced in the next ascent.

2. The method as set forth in claim 1 wherein the step of assigning includes a step of providing a message to waiting lobby passengers, the message being expressive of the assigned next sector.

3. The method as set forth in claim 1, wherein the step of assigning includes a step of initializing a timer to record an elapsed time between the time the next sector is assigned and a time that the elevator car arrives at the lobby.

4. The method as set forth in claim 3 wherein, during the travel of the elevator car towards the lobby, and after executing the step of assigning, and responsive to a registration of a hall call at a floor landing that is intermediately located between a current position of the elevator car and the lobby, wherein the method further comprises the steps of:

stopping the elevator car to service the registered hall call;

determining if the elapsed time exceeds a predetermined threshold, and, if the elapsed time is found to exceed the predetermined threshold, relinquishing the assigned sector.

5. The method as set forth in claim 4 wherein the step of assigning includes a step of providing a message to waiting lobby passengers, the message being expressive of the assigned next sector, and wherein the step of relinquishing includes a step of removing the provided message.

6. The method as set forth in claim 1 wherein the step of assigning includes a step of determining the next sector in accordance with a selected arbitration technique that is accomplished in accordance with the communicated information.

7. The method as set forth in claim 1 wherein the predetermined sector AFP is a fixed point.

8. The method as set forth in claim 7 wherein the predetermined sector AFP is approximately equal to the Turn Around Point.

9. The method as set forth in claim 1 wherein the sector AFP is a variable point that is determined by a group control means.

10. The method as set forth in claim 9 wherein the sector AFP is a function of measured passenger traffic.

11. The method as set forth in claim 9 wherein the sector AFP is a function of an estimate of passenger traffic based upon a historical record of passenger traffic.

12. The method as set forth in claim 1, and, during the travel of the elevator car towards the lobby, and responsive to the determination that the elevator car has reached the sector AFP, comprising the additional steps of:

determining if one or more hall calls are registered at floor landings that are intermediately located between the sector AFP and the lobby; and if so, stopping the elevator car to service the registered hall call or hall calls if they are assigned to this car; and if it is determined that no hall calls are registered at floor landings that are intermediately located between the sector AFP and the lobby, executing the step of communicating and the step of assigning, and further executing a step of providing a message to waiting lobby passengers, the message being expressive of the assigned next sector.

13. A method of operating an elevator system that includes a group of elevator cars servicing a plurality of floor landings divided into sectors, comprising the steps of:

with control means associated with each elevator car of the group, determining when the elevator car has reached a Turn Around Point (TAP), for reversing ascent and returning the elevator car to a lobby;

initiating descent of the elevator car to the lobby;

determining when the elevator car has reached a predetermined sector Assignment Fixation Point (AFP), after which assignment of a next sector to be serviced by the car in a next ascent is initiated;

communicating sector-related information with other control means of other elevator cars of the group;

based upon the communication, assigning to the elevator car, in accordance with a selected arbitration technique, the next sector to be serviced in the next ascent;

initializing a timer to record an elapsed time between the time the next sector is assigned and a time that the elevator car arrives at the lobby;

providing a message to waiting lobby passengers, the message being expressive of the assigned next sector; and, responsive to a registration of a hall call at a floor landing that is intermediately located between a current position of the elevator car and the lobby, stopping the elevator car to service the registered hall call;

determining if the elapsed time exceeds a predetermined threshold; and, if the elapsed time is found to exceed the predetermined threshold, relinquishing the assigned next sector.

14. The method as set forth in claim 13 wherein the step of relinquishing includes a step of removing the provided message.

15. The method as set forth in claim 13 wherein the predetermined sector AFP is a fixed point.

16. The method as set forth in claim 13 wherein the predetermined sector AFP is a variable point that is determined by a group control means in accordance with a measure of passenger traffic and/or accordance with a historical record of passenger traffic.

17. An elevator system that includes a group of elevator cars servicing a plurality of floor landings divided into sectors, comprising:

control means associated with each elevator car of the group, said control means including means for determining when the elevator car has reached a Turn Around Point (TAP) for reversing ascent and returning the elevator car to a lobby and for initiating descent to the lobby;

means for determining, during descent of the elevator car to the lobby and before reaching a Control Stop Point (CSP) where the elevator car begins to decelerate, when the elevator car has reached a sector Assignment Fixation Point (AFP), after which assignment of a next sector to be serviced by the car in a next ascent is initiated;

means, responsive to the determination that the elevator car has reached the sector AFP, for communicating sector-related information with other control means of other elevator cars of the group; and means, responsive to the communication, for assigning to the elevator car the next sector to be serviced by the car in the next ascent.

18. The elevator system as set forth in claim 17 and further including means for providing a message to waiting lobby passengers, the message being expressive of the assigned next sector, the message providing means being coupled to the assigning means.

19. The elevator system as set forth in claim 18 and further including timer means coupled to the assigning means and responsive thereto for being initialized to record an elapsed time between the time the next sector is assigned and a time that the elevator car arrives at the lobby, wherein said control means is responsive to a registration of a hall call at a floor landing that is intermediately located between a current position of the elevator car and the lobby for stopping the elevator car to service the registered hall call and for determining if the elapsed time exceeds a predetermined threshold; and, if the elapsed time is found to exceed the predetermined threshold, for relinquishing the assigned next sector and for removing the provided message.

20. The elevator system as set forth in claim 17 wherein said assigning means determines the next sector in accordance with a selected arbitration technique that is accomplished in accordance with the communicated information.

21. The elevator system as set forth in claim 17 wherein the sector AFP is a variable point that is determined by a group control means in accordance with a measure of passenger traffic and/or in accordance with a historical record of passenger traffic, said group control means being coupled to each of said elevator car control mans for communicating the sector AFP thereto.

* * * * *